United States Patent [19]

Fuchs

[11] 4,309,824

[45] Jan. 12, 1982

[54] METHOD AND AN ARRANGEMENT FOR PRODUCING A CURVED SAIL

[76] Inventor: Alfred Fuchs, Radolfzellerstr. 11, 7750 Konstanz, Fed. Rep. of Germany

[21] Appl. No.: 13,438

[22] Filed: Feb. 21, 1979

[30] Foreign Application Priority Data

Feb. 24, 1978 [DE] Fed. Rep. of Germany ..... 2807954

[51] Int. Cl.[3] ..... B63H 9/06

[52] U.S. Cl. ..... 33/174 G; 33/21 R; 33/176; 114/103

[58] Field of Search ..... 114/102, 103, 39; 9/6 R, 6 P, 6.5; 83/176, 925 CC; 249/155; 269/45, 266; 29/559; 264/313, 316; 33/1 AA, 14, 16, 174 G, 176

[56] References Cited

U.S. PATENT DOCUMENTS 3,618,886 11/1971 Graham ..... 249/155

3,974,791 8/1976 Haarstick et al. ..... 114/103

FOREIGN PATENT DOCUMENTS 269728 2/1964 Australia ..... 114/103

*Primary Examiner*—George E. A. Halvosa
*Assistant Examiner*—Jesus D. Sotelo
*Attorney, Agent, or Firm*—Watson, Cole, Grindle & Watson

[57] ABSTRACT

A working surface reproducing the final shape of the sail is used on which webs of sail cloth are placed, then cut to size and joined together in the pre-selected shape of the sail, and subsequently the area of the sail is marked and cut out by adjustable tracing bars. The working surface is of adjustable shape, designed to match the final shape of the sail, and is provided by a shaped flexible plate. This plate may be bent from an approximately flat normal position to form a convex and/or concave working surface.

9 Claims, 9 Drawing Figures

METHOD AND AN ARRANGEMENT FOR PRODUCING A CURVED SAIL

FIELD OF THE INVENTION

The invention relates to a method and apparatus for producing a curved sail.

PRIOR ART

In the conventional manufacture of sails there are several known sources of errors during the operations of marking, cutting, sewing together and adhering or welding, especially if the final shape of the sails is to be curved, i.e. if they are to be provided with a convexity. Sails of this type are at present joined together on a flat base, for example on a marking board or a cutting table. In order to produce the sail curvature, the individual webs of sail cloth are marked with the aid of templates, rulers or flexible tracing bars, and then cut by means of a razor, shears or a hot cutter. These operations and also the sewing or welding of the individual webs themselves may only be carried out by experienced and skilled trained workers and even then errors are frequently in evidence. For the more exacting yachtsmen, regatta yachtsmen for instance, the webs of sail cloth are, before being sewn, adhered together extremely accurately one centimeter at a time by means of a double-sided adhesive tape—however errors occur even here.

When the webs of sail cloth have been sewn together, they still have to be marked at the luff, leech and foot and cut and at present this also takes place on a flat surface. As, however, the sail webs are cut and sewn with a curvature, a great many creases form with this method during the marking, these creases pushing outwards so that it is virtually impossible to mark and cut off on the curved sail shape accurately. However, as the greatest accuracy is necessary precisely at the luff or the mast edge, to thus ensure that the required wind flow angle is exactly correct from the bottom to the top, only a few particularly carefully made sails could previously meet the yachtsman's requirements.

An additional difficulty arises as a result of the varying qualities of the cloth and the flexibility which frequently vary even within specific makes.

SUMMARY OF THE INVENTION

With these facts in mind, the inventor set himself the task of producing a method and an apparatus for producing curved sails by which the presently known drawbacks are avoided and which not only allow complicated sail blanks to be produced in a simple manner but also enable the sails to be matched to the varying requirements of the customers at a reasonable cost.

Achieving this task entails the use of a working surface reproducing the final shape of the sail, on which webs of sail cloth are placed, then cut to size and joined together in the pre-selected shape of the sail, whereupon the area of the sail is marked and cut out by means of adjustable tracing bars. A deformable working surface, which is designed so that it may be adapted to the final shape of the sail, is used for this purpose and is formed according to the invention by a flexible shaped plate in a frame. This shaped plate is attached to positioning brackets of adjustable length, if necessary telescopically, or lifting devices, for example hydraulic cylinders. It may be held both in a flat normal position by these or be brought into a convex or concave shape relative to this. The considerable advantage of this adjustable arrangement is that the webs of sail cloth can be given the required sail shape immediately and yet corrections can be made.

According to a further feature of the invention, tracking bars are attached in a hinged or similar manner in the region of the working surface, these bars facilitating, on the one hand, the cutting to size of the individual webs of cloth and, on the other hand, rendering it possible to cut the sail which is made on the working surface exactly to size.

According to the invention, the flexibility of the shaped plate is aided by the fact that the positioning brackets or lifting devices respectively are fixed detachably on the shaped plate and/or on the frame and are interchangeable as a function of the required form of the plate. Also, the shaped plate can be joined to the frame in an advantageous manner at its longitudinal edges in the region of top sections which if necessary are joined to the frame by inclinable parts.

Coupling brackets, which are preferably of U-shaped construction and are mounted on the frame in a hinged manner by means of one of their arms, are provided on the frame and/or on the top sections for the attachment and guiding of the afore-mentioned tracing bars or the like. The other arm then receives the tracing bar which is therefore placed in a hinged and lockable manner on the arm overlapping the shaped plate.

Furthermore, it has proved to be advantageous to assign at least one bracket similar to the coupling bracket to the tracing bar—which is of a different length, on the one hand, for cutting the individual cloth webs to size and on the other hand for cutting the finished sail to size. If necessary it is even of adjustable length so that the tracing bar can be secured by this bracket.

It is also possible within the scope of the invention for the shaped plate to be composed of several individual sheets which overlap one another in the region of their joints and thus contribute to the flexibility of the working surface.

The described method and apparatus make it possible for a plurality of sail shapes to be produced with a single machine and also for adaptations to be made to the respective properties of the material. It is even possible to adjust the working surface immediately before the start of the manufacturing process in accordance with the customer's spontaneous wishes. If the arrangement according to the invention is controlled by hydraulic devices, the adjustment of the relevant shape can be made in an unusually short time, if necessary from a control desk.

BRIEF DESCRIPTION OF THE DRAWING

Further advantages, features and details of the invention will be evident from the following description of preferred exemplary embodiments and also by reference of the drawings in which.

DETAILED DESCRIPTION

Figure 1:
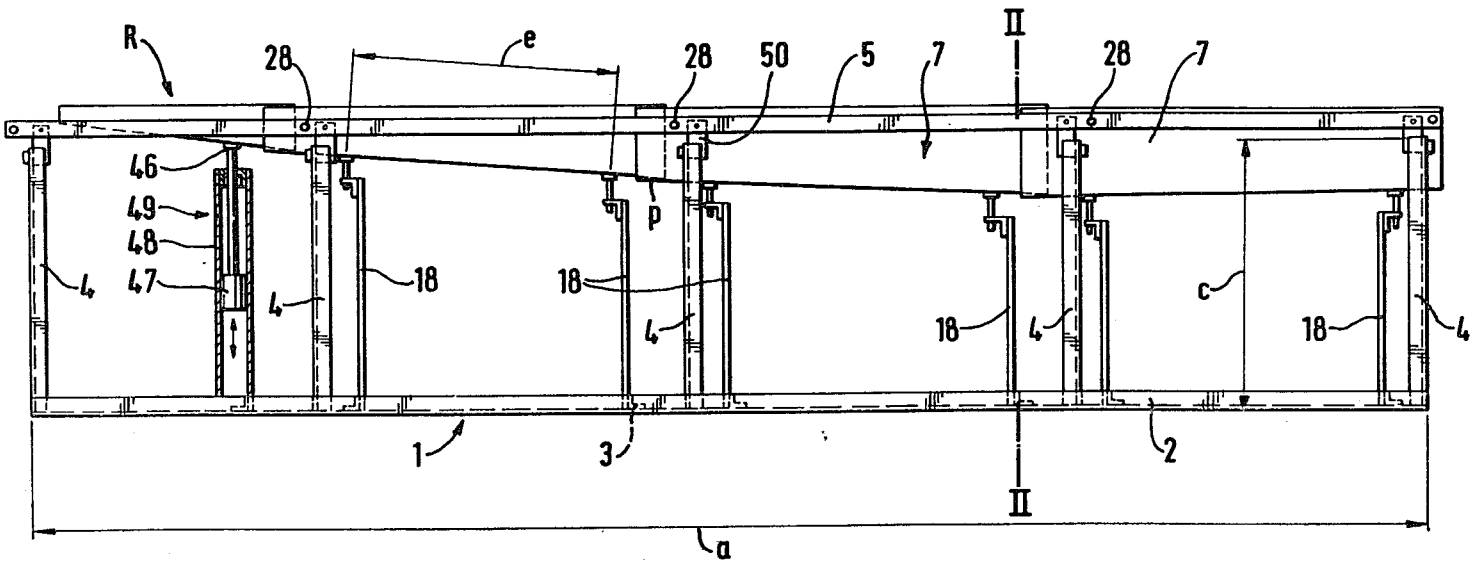
FIG. 1 is a side view of apparatus for producing sails.

The frame 1 of length a of an R for producing sails is composed of holed angle sections, lateral vertical struts 4 of height c projecting from a base frame consisting of longitudinal sections 2 and transverse sections 3 inserted between these in the manner of crossbars. Also, there are top sections 5 attached to the struts 4 by means of clips 50 of adjustable inclination.

Coupling brackets 6 for additional devices are provided on the upper ends of the vertical struts 4 or on the top sections 5. A flexible plate 7 is clamped between the top sections 5, this plate consisting in the exemplary embodiment of several individual plates overlapping at the junction points p. Bores 8 or similar recesses for adjustable set screws 9 are provided in the plate 7, one in front of the other at longitudinal spacing e and transverse spacing f. The flat head 10 of each set screw 9 has a recess 11 for a polyhedral key and rests in a correspondingly inclined collar 12 in the bore 8. A nut 14 with washer 13 and counter nut 15 are secured to the set screw 9 below the plate 7.

Figure 4:
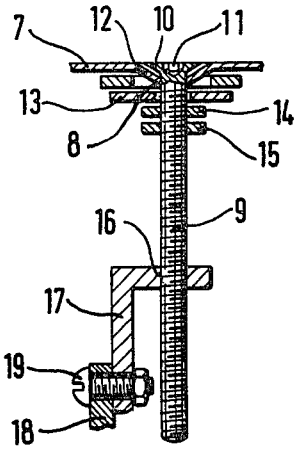
FIGS. 4 and 5 respectively, are enlarged details from FIGS. 1 to 2 respectively.

Each of the set screws 9 passes through a threaded bore 16 of angle-iron 17 which is held on the upper end of a positioning bracket 18 by a screw 19 (FIG. 4). This positioning bracket 18 is detachably secured at its lower end 20 by screws 21 to one of the transverse sections 3.

A lifting device 49 is associated with the positioning brackets 18 and comprises a hydraulic cylinder 48 and lifting piston 47 seen in FIGS. 1 at the left-hand side of the arrangement R. By means of attachment head 46 on lifting device 49, the shape of the plate 7 can be altered in a suitable manner with the aid of the positioning brackets 18 as follows.

Figure 2:
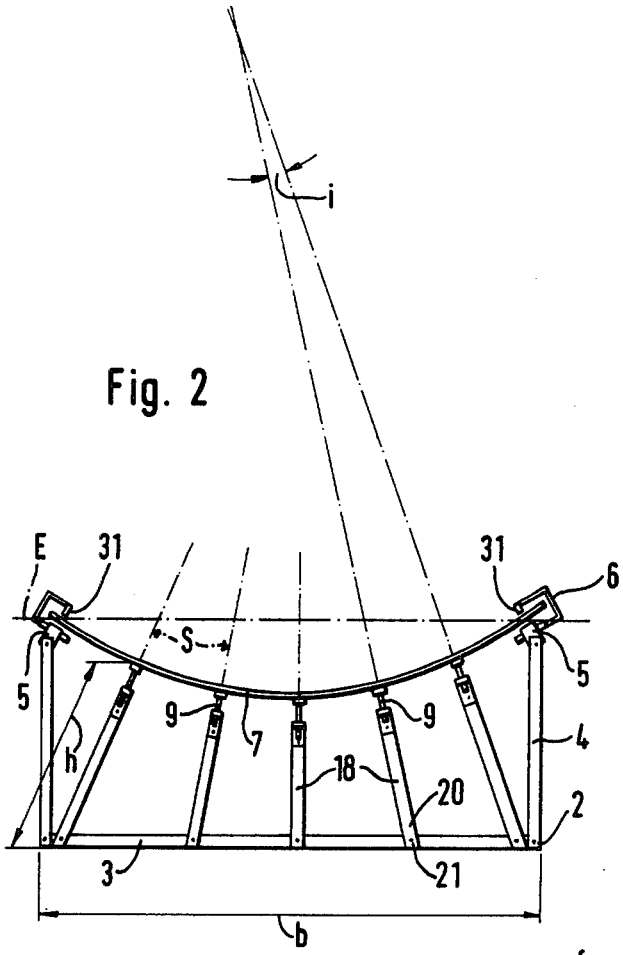
FIGS. 2 and 3 are cross-sections taken in FIG. 1 along line II—II in different operating positions.
Figure 3:
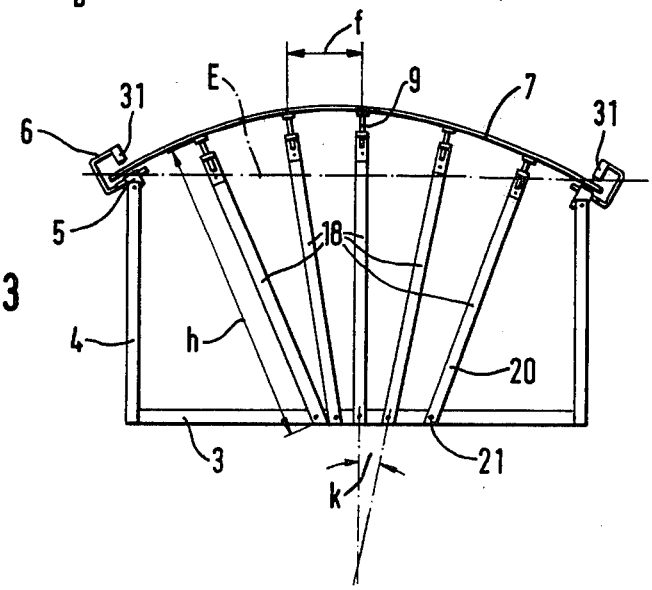
Figure 5:
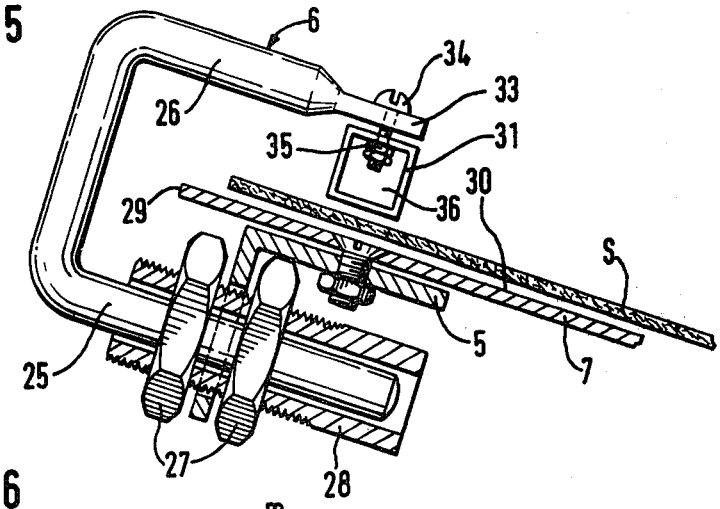
Figure 6:
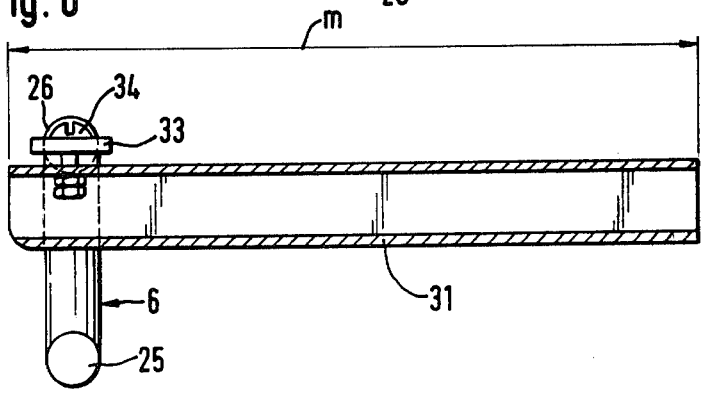
FIG. 6 is a transverse section through FIG. 5

The length h of the individual positioning brackets 18—with set screws 9—of a transverse section 3 are, on the one hand, different and, on the other hand, adjustable in order to keep the shaped plate 7 curved from a plane E downwards (FIG. 2) or upwards (FIG. 3), this plate extending over the entire breadth b of the apparatus R and having webs of sail cloth S resting on its surface 30 according to FIG. 5.

The coupling bracket 6, in the shape of a U, is held in a holder 28 by nuts 26 on one arm 25, so that the other arm 26 overlaps the longitudinal edge 29 of the shaped plate 7. In FIG. 5, a short tracing bar 31 of length m and consisting of a box-like profiled rod runs approximately parallel to the edge of the plate 7, this bar being attached to a flattened portion 33 of the holding bracket 6 by means of a screw 34, the nuts 35 on the screw being disposed inside the profiled rod 36. This tracing bar 31 serves to mark out and cut off the webs of sail cloth S.

Each web of sail cloth S is laid on the surface 30 of the shaped plate 7 which has first been adjusted in accordance with the required sail shape. In this connection, the positioning brackets 18 (and the lifting devices 49) are adjusted with respect to their length h and/or their hinge positions 21 in the manner shown in FIGS. 2 and 3. In each case according to the proposed cross-sectional line of the shaped plate 7 the axes of the set screws 9 or attachment heads 46 produce acute angles i (FIG. 2) above the shaped plate 7 or angles k (FIG. 3) below the shaped plate.

The preselectable form of the shaped plate 7 now makes it possible for the sail to be cut to size in the intended sail shape, as a result of which it is no longer necessary to make templates, mark out the webs of sail cloth S, cut them out and secure them together centimeter by centimeter at the sewing points with double sided adhesive tape.

The webs of sail cloth S, which are not illustrated in detail, are cut off by means of the short tracing bar 31 and then adhered or welded together and reinforcements and batten pockets are glued in. The entire area of the sail to be made is then marked by means of a long tracing bar 31*a* and cut to this size.

Figure 7:
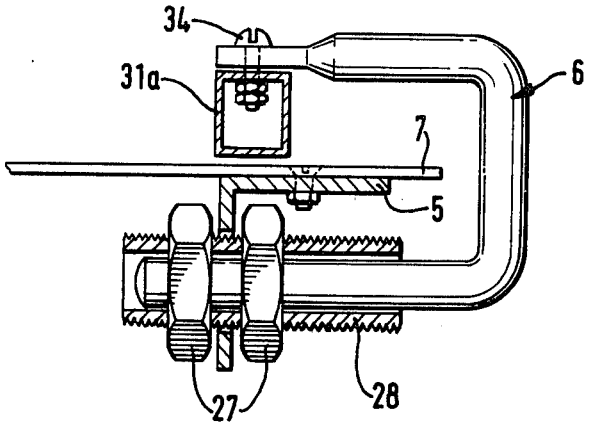
FIGS. 7 and 9 are further enlarged details of the apparatus.
Figure 8:
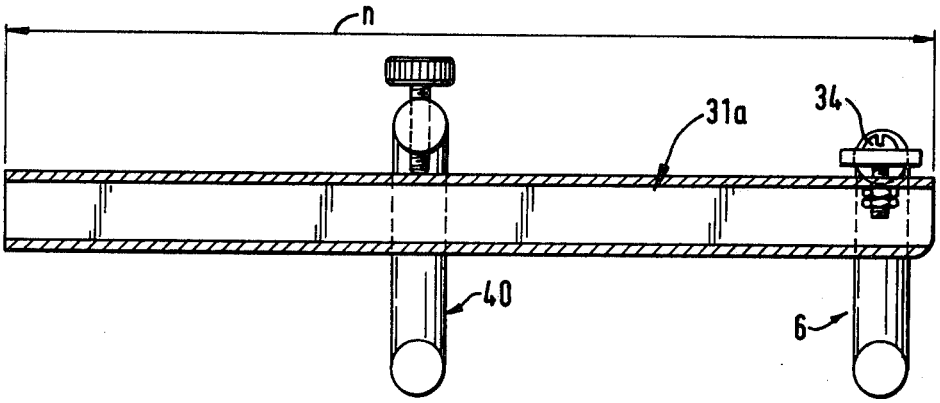
FIG. 8 is a transverse section through FIG. 7.
Figure 9:
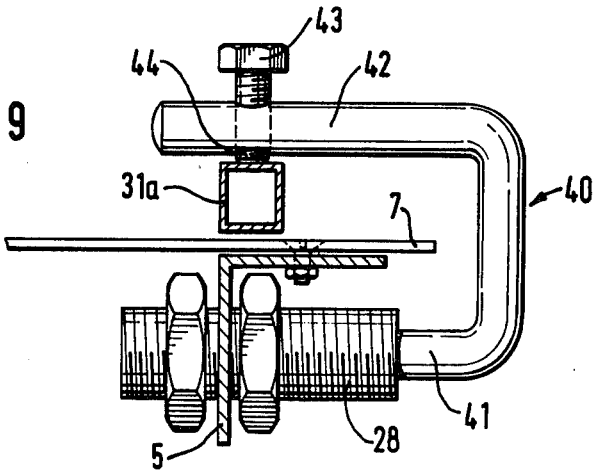

The long tracing bar 31*a* of length n is positioned in accordance with FIG. 7 by means of screws 34 on the coupling bracket 6 and is overlapped by an additional holding bracket 40 which is secured in turn in a holder 28 by means of one arm 41. The upper arm 42 receives a set screw 43 whose tip 44 presses against the tracing bar 31*a*.

I claim:

1. An apparatus for producing a curved sail from webs of material, comprising flexible plate means having a work surface, frame means for supporting and deforming said plate to the curved shape of a sail to be produced, bracket means adjacent opposed edges of said plate, said bracket means being pivotally mounted on said frame means for movement together with said plate when deformed to said curved shape, and means on said bracket means for marking and cutting to size the webs while on said work surface and for marking and cutting to size webs assembled as a sail.

2. The apparatus according to claim 1, wherein said bracket means are adjustable for movement toward and away from said edges of said plate.

3. The apparatus according to claim 2, wherein said marking and cutting means are adjustable for inclined movement relative to said edges of said plate.

4. The apparatus according to claim 1, wherein said plate is normally planar and is deformed to concave or convex curved form.

5. The apparatus according to claim 1, wherein said frame means comprises positioning brackets of adjustable length for engaging said plate, and lifting means for applying force to said plate.

6. The apparatus according to claim 5, wherein said positioning brackets and lifting means are detachably coupled to said plate to be interchangeable as a function of the desired shape of the plate.

7. The apparatus according to claim 1, wherein said marking and cutting means comprises a tracing member attached to at least one of said bracket means.

8. The apparatus according to claim 7, wherein said one bracket means includes opposed arms, one secured to the plate from below and the other extending above the plate, said tracing member being attached in detachable and lockable manner on said other arm.

9. The apparatus according to claim 1, wherein said plate comprises a plurality of sheets which overlap one another.

* * * * *